US007909637B2

(12) United States Patent
Montena

(10) Patent No.: US 7,909,637 B2
(45) Date of Patent: Mar. 22, 2011

(54) COAXIAL CONNECTOR WITH INTEGRATED MATING FORCE SENSOR AND METHOD OF USE THEREOF

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/579,435

(22) Filed: Oct. 15, 2009

(65) Prior Publication Data

US 2010/0124839 A1 May 20, 2010

Related U.S. Application Data

(63) Continuation-in-part of application No. 12/271,999, filed on Nov. 17, 2008.

(51) Int. Cl.
*G08B 21/00* (2006.01)

(52) U.S. Cl. ..... 439/489

(58) Field of Classification Search ..... 439/488, 439/489, 578, 675; 340/635, 568.4, 686.4, 340/656, 687

See application file for complete search history.

(56) References Cited

U.S. PATENT DOCUMENTS 3,196,424 A * 7/1965 Hardesty et al. ..... 439/490
3,388,590 A 6/1968 Bond
3,686,623 A 8/1972 Nijman
3,768,089 A * 10/1973 Costanzo ..... 340/687
3,808,580 A * 4/1974 Johnson ..... 439/321
3,945,704 A * 3/1976 Kraus et al. ..... 439/411
3,960,428 A * 6/1976 Naus et al. ..... 439/315
4,084,875 A * 4/1978 Yamamoto ..... 439/274
4,421,377 A 12/1983 Spinner
4,489,419 A 12/1984 Wang
4,911,655 A * 3/1990 Pinyan et al. ..... 439/412
4,915,639 A 4/1990 Cohn et al.
4,927,382 A * 5/1990 Huber ..... 439/490
5,059,948 A * 10/1991 Desmeules ..... 340/568.4
5,169,329 A 12/1992 Taguchi
5,194,016 A 3/1993 Hatagishi et al.
5,217,391 A 6/1993 Fisher, Jr.
5,225,816 A 7/1993 Lebby et al.
5,345,520 A 9/1994 Grile
5,355,883 A 10/1994 Ascher
5,462,450 A 10/1995 Kodama
5,490,033 A 2/1996 Cronin
5,518,420 A 5/1996 Pitschi
5,561,900 A 10/1996 Hosler, Sr.
5,904,578 A 5/1999 Kubota et al.
5,924,889 A 7/1999 Wang
6,041,644 A * 3/2000 Harde ..... 73/37
6,093,043 A 7/2000 Gray et al.
6,134,774 A 10/2000 Williams et al.
6,243,654 B1 6/2001 Johnson et al.
6,414,636 B1 7/2002 Godard et al.
6,570,373 B1 5/2003 Viola (Continued)

*Primary Examiner* — Neil Abrams
(74) *Attorney, Agent, or Firm* — Schmeiser, Olsen & Watts, LLP

(57) ABSTRACT

A mating force sensing coaxial cable connector is provided, the connector comprising: a connector body; a sensing circuit positioned on a face of an sensor insulator, the sensor insulator located at least partially within the connector body; a capacitive space in immediate proximity with the face of the sensor insulator upon which the sensing circuit is positioned; and a flexible abutment member having a portion thereof forming at least one boundary surface of the capacitive space, said flexible abutment member being movable due to mating forces.

25 Claims, 11 Drawing Sheets

U.S. PATENT DOCUMENTS

| | | | | |
|---|---|---|---|---|
| 6,618,515 | B2 | 9/2003 | Kimura et al. | |
| 6,650,885 | B2 | 11/2003 | Anderson et al. | |
| 6,755,681 | B2 | 6/2004 | Chen | |
| 6,783,389 | B1 | 8/2004 | Lee | |
| 6,896,541 | B2 | 5/2005 | Benson | |
| 7,029,327 | B2 | 4/2006 | Devine | |
| 7,254,511 | B2 | 8/2007 | Niedzwiecki et al. | |
| 7,262,626 | B2 | 8/2007 | Iwasaki | |
| 7,507,117 | B2 * | 3/2009 | Amidon | 439/584 |
| 7,544,086 | B1 * | 6/2009 | Wells | 439/489 |
| 7,733,236 | B2 * | 6/2010 | Montena et al. | 340/635 |
| 7,749,022 | B2 * | 7/2010 | Amidon et al. | 439/584 |
| 2003/0096629 | A1 | 5/2003 | Elliott et al. | |
| 2007/0173367 | A1 | 7/2007 | Duncan | |
| 2009/0096466 | A1 | 4/2009 | Delforce et al. | |
| 2010/0124838 | A1 | 5/2010 | Montena et al. | |

* cited by examiner

COAXIAL CONNECTOR WITH INTEGRATED MATING FORCE SENSOR AND METHOD OF USE THEREOF

CROSS-REFERENCE TO RELATED APPLICATION

This application is a continuation-in-part of and claims priority from co-pending U.S. application Ser. No. 12/271,999 filed Nov. 17, 2008, and entitled COAXIAL CONNECTOR WITH INTEGRATED MATING FORCE SENSOR AND METHOD OF USE THEREOF.

BACKGROUND OF INVENTION

1. Technical Field

The present invention relates generally to coaxial connectors. More particularly, the present invention relates to a coaxial connector having an integrated mating force sensor and related method of use.

2. Related Art

Cable communications have become an increasingly prevalent form of electromagnetic information exchange and coaxial cables are common conduits for transmission of electromagnetic communications. In addition, various coaxial cable connectors are provided to facilitate connection of cables to various devices. It is important that a coaxial cable connector be properly connected or mated to an interface port of a device for cable communications to be exchanged accurately. One way to help verify whether a proper connection of a coaxial cable connector is made is to determine and report mating force in the connection. However, common coaxial cable connectors have not been provided, whereby mating force can be efficiently determined by the coaxial cable connectors. Ordinary attempts at determining mating force have generally been inefficient, costly, and impractical involving multiple devices and complex applications. Accordingly, there is a need for an improved connector for determining mating force. The present invention addresses the abovementioned deficiencies and provides numerous other advantages.

SUMMARY OF THE INVENTION

The present invention provides an apparatus for use with coaxial cable connections that offers improved reliability.

A first aspect of the present invention provides A coaxial cable connector for connecting a coaxial cable to a mating component, the mating component having a conductive interface sleeve, the coaxial cable connector comprising: a connector body having an internal passageway defined therein; a first insulator component disposed within the internal passageway of the connector body; a capacitive circuit positioned on a face of the first insulator component, the first insulator component at least partially defining a first plate of a capacitor; and a flexible member in immediate proximity with the face of the first insulator component, the flexible member at least partially defining a capacitive space between the face of the first insulator and the flexible member, wherein the flexible member is movable upon the application of mating forces created as the conductive interface sleeve interacts with the flexible member.

A second aspect of the present invention provides a coaxial cable connector comprising: a connector body; a capacitive circuit positioned on a face of a first insulator component, the first insulator component located within the connector body; a flexible member located proximate the face of the first insulator component, the flexible member being movable due to mating forces when the connector is connected to a mating component; and a capacitive space located between the face of the first insulator component and the flexible member; wherein the flexible member forms at least one boundary surface of the capacitive space, and the face of the first insulator forms at least another boundary surface of the capacitive space.

A third aspect of the present invention provides a mating force sensing coaxial cable connector comprising: a sensing circuit printed on the face of a first spacer component positioned to rigidly suspend a center conductor contact within an outer conducting housing; and a capacitive space in immediate proximity with the sensing circuit, said capacitive space having at least one defining wall configured to undergo elastic deformation as a result of mating forces.

A fourth aspect of the present invention provides a coaxial cable connector comprising: a connector body; an insulator component and an interface sleeve housed by a connector body; a capacitive space formed between the insulator component and the interface sleeve; and means for sensing proper mating by determining a change in size of the capacitive space due to mating forces.

A fifth aspect of the present invention provides a method for detecting mating force of a mated coaxial cable connector, said method comprising: providing a coaxial cable connector including: a sensing circuit positioned on a face of a spacer component located within a connector body; a capacitive space in immediate proximity with the sensing circuit; and an interface component having a flexible member forming at least one boundary surface of the capacitive space, said flexible member being movable due to mating forces; mating the connector with a connecting device; bending the flexible member of the interface component due to contact with the connecting device during mating, thereby reducing the size of capacitive space; and detecting mating force by sensing the reduction of size of the capacitive space by the sensing circuit.

A sixth aspect of the present invention provides a connector body having a first end and a second end, the first end having a first bore; a first insulator located within the first bore, the first insulator having a first face; a mount portion defined on the first face; a capacitive circuit positioned on the mount portion; and, an interface member, having a first section and a second section, the interface member located within the first bore in immediate proximity to the mount portion to define a capacitive space, the first section having a first section bore, the first and second sections being movable between a first position and a second position upon the application of an axial force on the first section.

A seventh aspect of the present invention provides a male coaxial cable connector for connecting a coaxial cable to a female mating component, the female mating component having a conductive interface sleeve, the male coaxial cable connector comprising: a connector body, configured to receive a coaxial cable; a male center conductor contact, electrically coupled to the coaxial cable; a conductive interface sleeve, coaxially surrounding at least a portion of the male center conductor contact; a sensor insulator, spanning a radial distance between the conductive interface sleeve and the male center conductor contact; a capacitive circuit positioned on a sensor face of the sensor insulator; and, a flexible abutment member having a cavity wall, wherein the cavity wall at least partially defines a capacitive space between the sensor face of the sensor insulator and the flexible abutment member, wherein the cavity wall is movable upon the application of mating forces upon the flexible abutment member.

An eighth aspect of the present invention provides a male coaxial cable connector comprising: a male center conductor;

a capacitive circuit positioned on a sensor face of a sensor insulator, the sensor insulator positioned within the connector to rigidly suspend the male center conductor contact in a coaxial location with respect to an outer connector body; a flexible abutment member having a cavity wall, the cavity wall located proximate the sensor face of the sensor insulator, the cavity wall of the flexible abutment member being movable due to mating forces when the connector is connected to a mating component; and a capacitive cavity located between the sensor face of the sensor insulator and the cavity wall of the flexible abutment member; wherein the cavity wall of the flexible abutment member forms at least one boundary surface of the capacitive cavity, and the sensor face of the sensor insulator forms at least another boundary surface of the capacitive space.

A ninth aspect of the present invention provides a mating force sensing male coaxial cable connector comprising: a sensing circuit printed on the face of a sensor insulator positioned to rigidly suspend a male center conductor contact within an outer conducting sleeve; and a capacitive space in proximity with the sensing circuit, said capacitive space having at least one defining wall configured to undergo elastic deformation as a result of mating forces.

A tenth aspect of the present invention provides a male coaxial cable connector comprising: a connector body; an sensor insulator and a flexible abutment member at least partially housed by the connector body; a capacitive space formed between the sensor insulator and the flexible abutment member; and means for sensing proper mating by determining a change in size of the capacitive space due to mating forces.

An eleventh aspect of the present invention provides a method for detecting mating force of a mated male coaxial cable connector, said method comprising: providing a male coaxial cable connector including: a sensing circuit positioned on a face of a spacer component located within a connector body; a capacitive space in immediate proximity with the sensing circuit; and a flexible abutment member having a portion thereof forming at least one boundary surface of the capacitive space, said portion of the flexible abutment member being movable due to mating forces; mating the male connector with a connecting female device; bending the an axially displaceable element of the flexible abutment member to move the boundary surface portion thereof due to contact with the connecting female device during mating, thereby reducing the size of capacitive space; and detecting mating force by sensing the reduction of size of the capacitive space by the sensing circuit.

The foregoing and other features of the invention will be apparent from the following more particular description of various embodiments of the invention.

DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
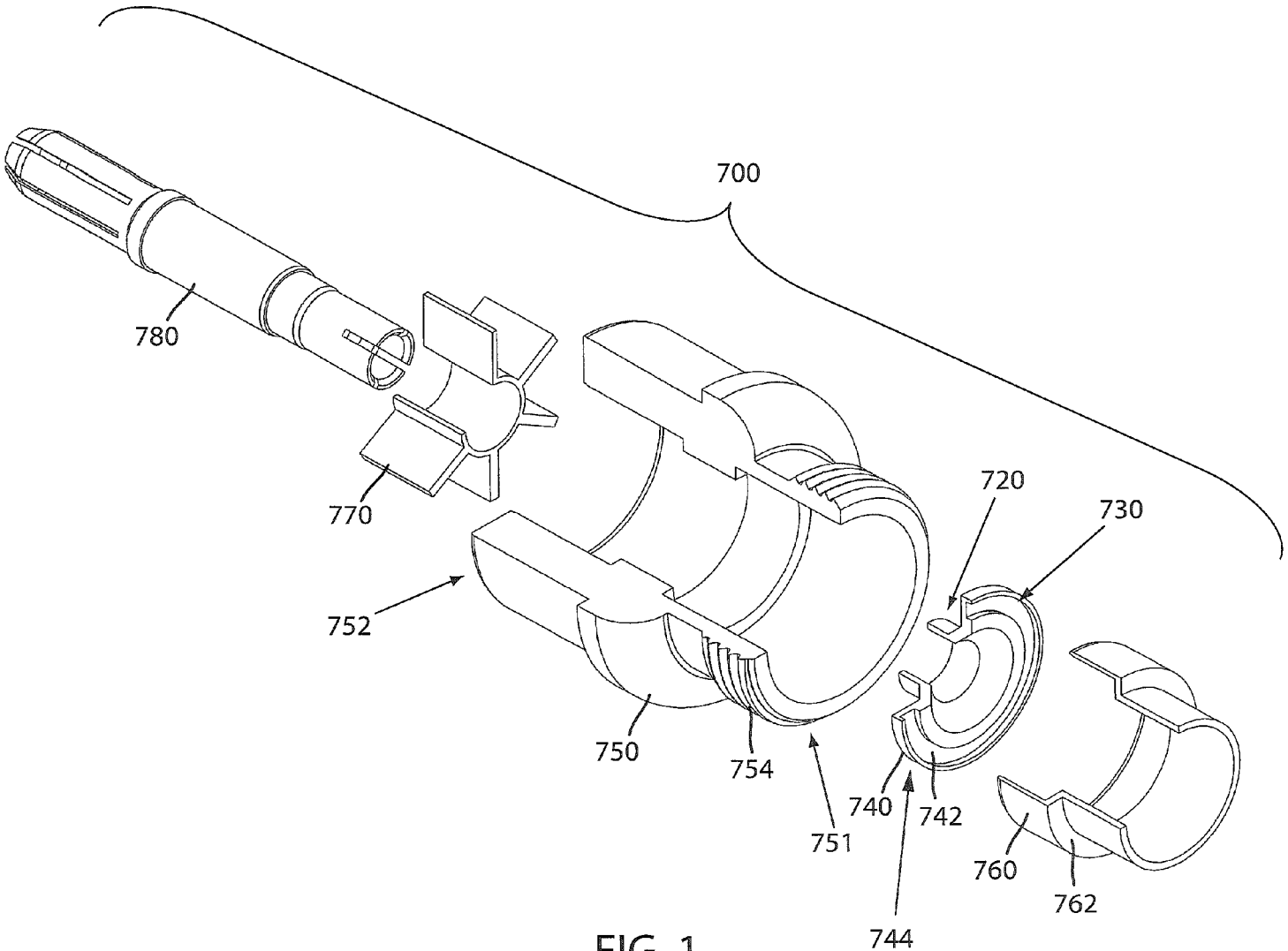
FIG. 1 depicts an exploded cut-away perspective view of an embodiment of a coaxial cable connector with integrated force sensor, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts an exploded cut-away perspective view of an embodiment of a coaxial cable connector 700 with integrated mating force sensing circuit 730, in accordance with the present invention. The connector 700 includes a connector body 750. The connector body 750 comprises an outer housing surrounding an internal passageway 755 (shown in FIG. 2) accommodating internal components assembled within the connector 700. In addition, the connector body 750 may be conductive. The connector 700 comprises a first spacer 740 being a first insulator component. A first end 751 of the connector body 750 includes a threaded surface 754. The first end 751 also includes an axial opening large enough to accommodate the first spacer 740 and an interface sleeve 760. Moreover, an opposing second end 752 of the connector body 750 includes an axial opening large enough to accommodate a second spacer 770. The second spacer 770 is a second insulator component and is located to operate with an internal surface of the connector body 750 to stabilize a center conductor contact 780 and help retain substantially axial alignment of the center conductor contact 780 with respect to the connector body 750 when the connector 700 is assembled.

The first spacer 740 is formed of a dielectric material and may be housed within the connector body 750 and positioned to contact and axially align the center conductor 780. The first spacer 740 is positioned to rigidly suspend the inner conductor contact 780 within the outer conducting housing or connector body 750. The first spacer 740 is an insulator component positioned to help facilitate an operable communication connection of the connector 700. In addition, the first spacer 740 may include a face 742 on which a sensing circuit 730 may be positioned. The face 742 may be the bottom of an annular ring-like channel formed into the first spacer 740 and the sensing circuit 730 may be printed onto the face 742. For example, a capacitive circuit may be printed on the face 742 of the first spacer 740, wherein the capacitive circuit is a sensing circuit 730. Printing the sensing circuit 730 onto a face 742 of the first spacer 740 affords efficient connector 700 fabrication because the sensing circuit 730 can be provided on components, such as the spacer 740, typically existent in cable connectors. Moreover, assembly of the connector 700 is made efficient because the various connector components, such as the first spacer 740, center conductor 780, interface sleeve 760, connector body 750 and second spacer 770 are assembled in a manner consistent with typical connector assembly. Printing a sensing circuit 730 on a typical component can also be more efficient than other means because assembly of small non-printed electronic sensors to the interior surfaces of typical connector housings, possibly wiring those sensors to a circuit board within the housing and calibrating the sensors along with any mechanical elements, can be difficult and costly steps. A printed sensing circuit 730 integrated on a typical connector 700 assembly component reduces assembly complexity and cost. Accordingly, it may be desirable to "print" sensing circuits 730 and other associated circuitry in an integrated fashion directly onto structures, such as the face 742 of the first spacer 740 or other structures already present in a typical connector 700. Furthermore, printing the sensing circuits 730 onto connector 700 components allows for mass fabrication, such as batch processing of the first spacers 40 being insulator components having sensing circuits 730 printed thereon. Printing the sensing circuit 730 may involve providing conductive pathways, or traces, etched from copper sheets or other conductive materials, laminated or otherwise positioned onto a non-conductive substrate, such as the first spacer insulator component 740.

An interface sleeve 760 of a connector 700 may include a flexible member 762. The flexible member 762 is a compliant element of the sleeve 760. Because the flexible member 762 is compliant, it can bend in response to contact with mechanical elements in the interface of another component, such as a male connector 500 (see FIGS. 4-6). Thus, the flexible member 762 may directly experience mating forces when connected to another component, such as a male connector 500, and undergo movement as a result, as will be discussed further herein below.

Figure 2:
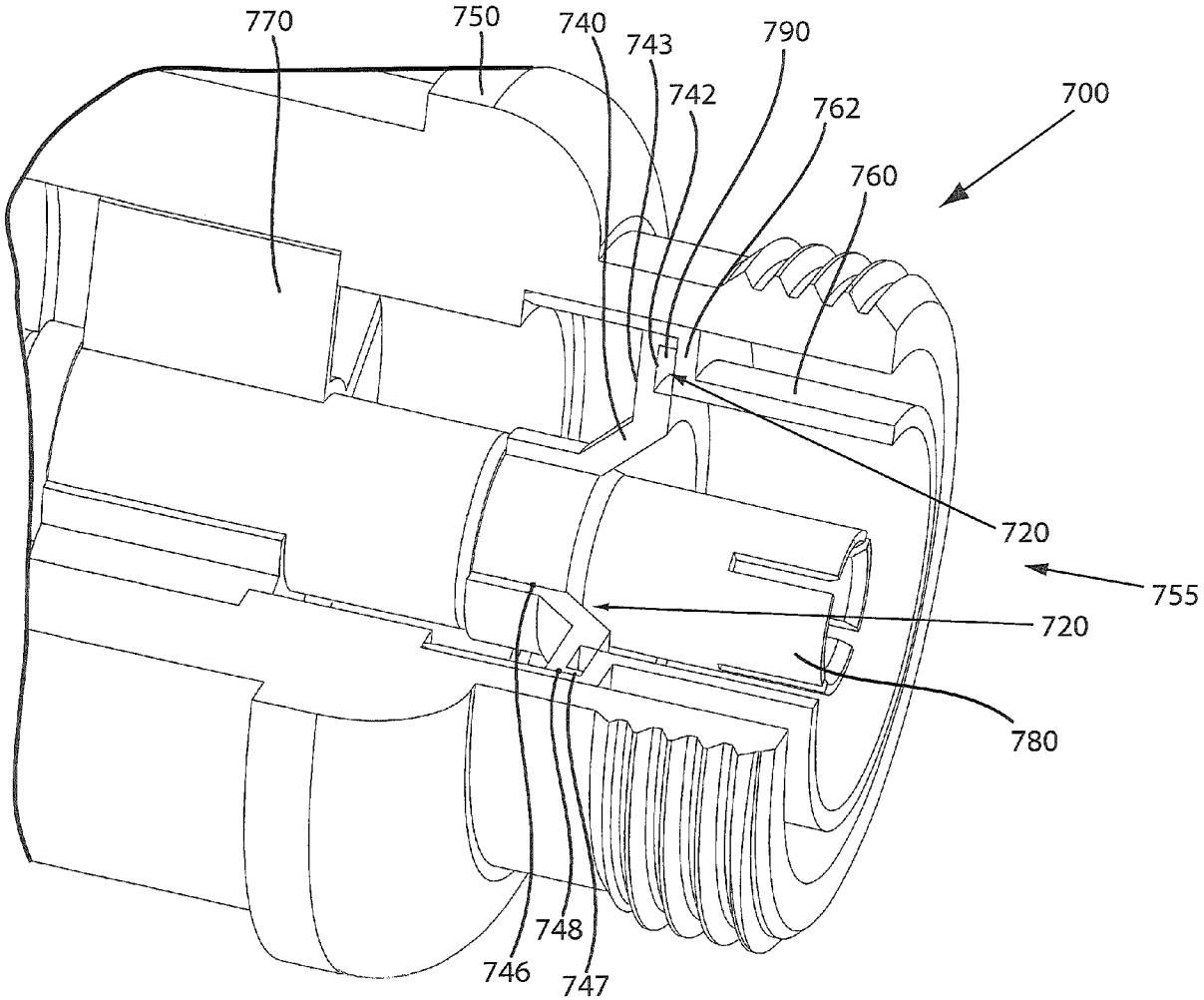
FIG. 2 depicts a close-up cut-away perspective view of a first end of an embodiment of a coaxial cable connector with integrated force sensor, in accordance with the present invention.

Referring further to the drawings, FIG. 2 depicts a close-up cut-away perspective view of a first end 751 of an embodiment of a coaxial cable connector 700 with integrated mating force sensing circuit 730, in accordance with the present invention. The sensing circuit may be printed on a face 742 of a first spacer 740 in proximity with a capacitive space 790, such as a resonant cavity or chamber in the interface between the first spacer 740 and the interface sleeve 760. The sensing circuit 730 may be a capacitive circuit. The capacitive space 790 cavity, such as a cavity or chamber may includes at least one wall or boundary surface movable due to mating forces. For example, a surface of the flexible member 762 of the interface sleeve 760 may comprise a boundary surface of the capacitive space 790. The flexible member 762 is a compliant portion of the interface sleeve 760 operable to endure motion due to movement from mating forces. Moreover, the flexible member 762 may be resilient and configured such that motions due to mating forces bend the member 762 within its elastic range so that the member 762 can return to its previous non-motivated position once the mating forces are removed. Additionally, the member 762 may also be configured to have some elastic hysteresis in that member 762 may be physically responsive relative to varying motive force and include inherent tendency to return to a previous dynamic physical condition. The flexible member 762 may be formed such that movement due to motive force is resistive to yielding and/or may also be cable of elastic response only within a specific range of movement. Nevertheless, some embodiments of the flexible member 762 may be designed to yield if moved too far by mating forces. The interface sleeve 760 may be formed of metals or metal alloys such as brass, copper, titanium, or steel, plastics (wherein the plastics may be formed to be conductive), composite materials, or a combination thereof.

When the connector 700 is assembled, the flexible member 762 is in immediate proximity with the capacitive space 790. Movements of the flexible member 762 cause changes in the size associated with the capacitive space 790. The capacitive space 790 size may therefore by dynamic. Changes in the size of the capacitive space 790 may produce changes in the capacitance of the printed sensing circuit 730 and are therefore ascertainable as a physical parameter status. The face 742 of the insulator may be or include a fixed electrode, such as a fixed plate 744, and the flexible member 762 may be or include a movable electrode. The distance between the electrodes, or the size of the capacitive space between the electrodes, may vary inversely with the applied torque. The closer flexible member 762 gets to the fixed plate 744, the larger the effective capacitance becomes. The sensing circuit 730 translates the changes in capacitance to connector tightness and determines if the connector 700 is too loose. The capacitive space 790 may be a resonant chamber or capacitive cavity. The dimensional space of the capacitive space 790 can be easily manufactured to very tight tolerances either by forming at least a portion of the space 790 directly into the first spacer 740, forming it into portion of the housing 750, forming it into a portion of the interface sleeve 760, or a combination of the above. For example, an annular channel may be formed in first spacer 740, wherein a capacitive sensing circuit 730 is positioned on the bottom face 742 of the channel to form an annular diaphragm capacitor responsive to resonant variation due to changes in the size of cavity 790. The capacitive space 790 may be filled with air, wherein the air may function as a dielectric. However, the capacitive space 790 may be filled with some other material such as dielectric grease. Moreover, portions of the cavity capacitive space 790 boundaries, such as surfaces of the spacer 740 or flexible member 760 may be coated with dielectric material. Because the connector 700 assembly creates a sandwich of parts, the capacitive space or resonant cavity 790 and sensing circuit 730 need not be adjusted or calibrated individually for each connector assembly, making assembly of the connector 700 no different from a similar common coaxial cable connector that has no sensing circuit 730 built in.

Power for the sensing circuit 730 may be provided through electrical contact with the center conductor 780. For instance, traces may be printed on the first spacer 740 and positioned so that the traces make electrical contact with the center conductor contact 780 at a location 746. Contact with the center conductor contact 780 at location 46 facilitates the ability for the sensing circuit 730 to draw power from the cable signal(s)

passing through the center conductor contact 780. Traces may also be formed and positioned so as to make contact with grounding components. For example, a ground path may extend through a location 748 between the first spacer 740 and the interface sleeve 760.

The sensing circuit 730 can communicate sensed mating forces. The sensing circuit 730, such as a capacitive circuit, may be in electrical communication with an output component such as traces physically and electrically connected to the center conductor contact 780. For example, sensed conditions due to mating forces, such as changes in capacitance of the cavity or chamber 790, may be passed as an output signal from the sensing circuit 730 of the first spacer 740 through an output component 720, such as traces, electrically linked to the center conductor contact 780. The outputted signal(s) can then travel along the cable line corresponding to the cable connection applicable to the connector 700. Hence, the signal(s) from the sensing circuit 730 may be accessed at a point along the cable line. In addition, traces or conductive elements of an output component 720 in communication with a sensing circuit 730 may be in electrical contact with output leads available to facilitate connection of the connector 700 with electronic circuitry that can manipulate the sensing circuit 730 operation.

A portion of the first spacer 740, such as a flange 747, may be compressible or bendable. As the flexible member 762 of the interface sleeve 760 moves due to mating forces, the flange 747 may compress or bend as it interacts with the flexible member 762. The compressible or bendable nature of a portion of the first spacer 740, such as flange 747, may permit more efficient movement of the flexible member 762. For instance, the flange 747 may contribute resistance to movement of the flexible member 762, but still allow some bending of the member. In addition, the first spacer 740 may bend with respect to a rear wall or surface 743 as the flexible member 762 bends due to mating forces and interacts with the first spacer 740.

Figure 3:
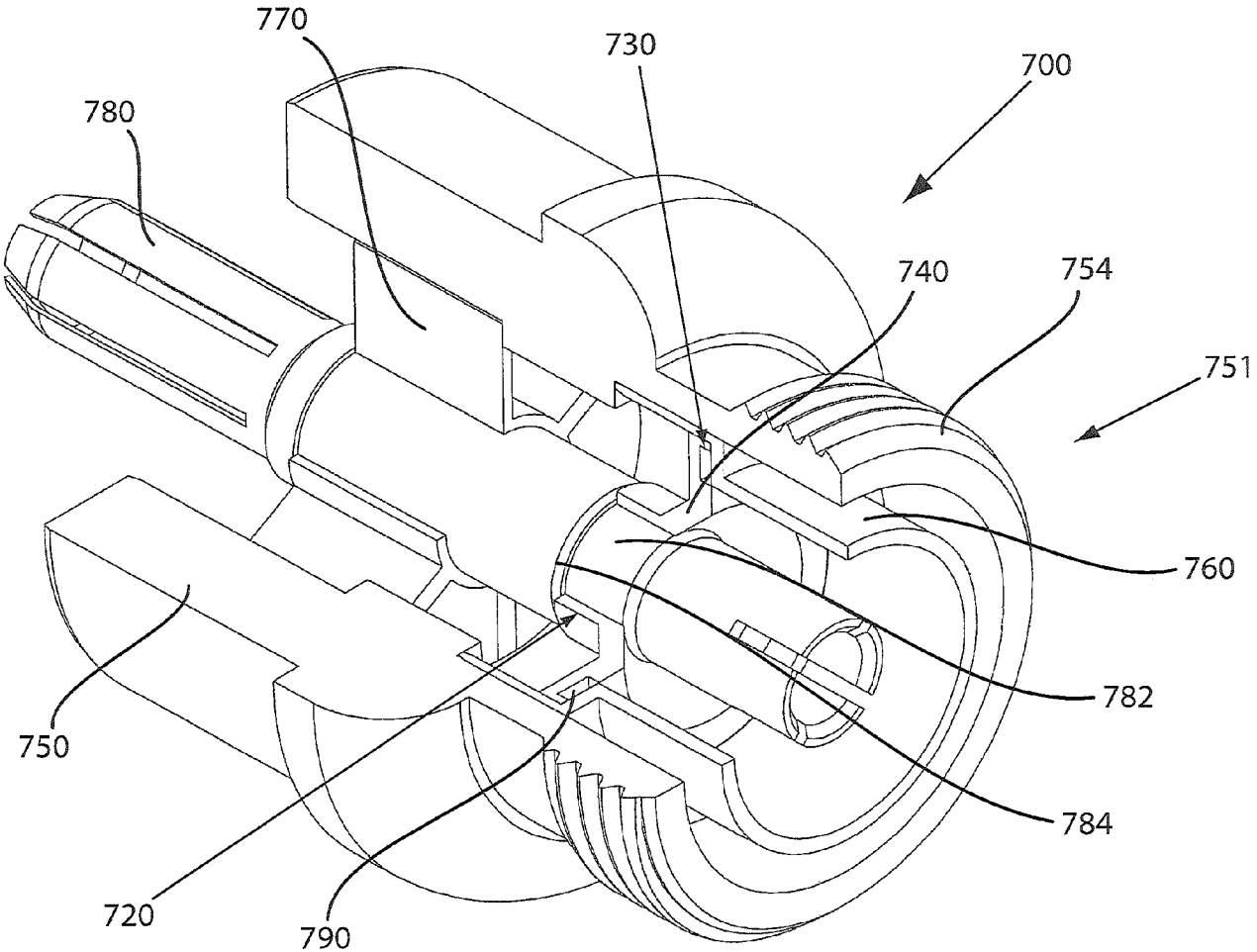
FIG. 3 depicts a cut-away perspective view of an embodiment of an assembled coaxial cable connector with integrated force sensor, in accordance with the present invention.

FIG. 3 depicts an embodiment of an assembled coaxial cable connector 700 with integrated mating force sensing circuit 730. The threaded surface 754 of the first end of connector body 750 facilitates threadable mating with another coaxial cable component, such as a male connector 500 (see FIGS. 4-6). However, those in the art should appreciate that the connector 700 may be formed without threads and designed to have a tolerance fit with another coaxial cable component, while the sensing circuit 730 is still able to sense mating forces. As shown the second spacer 770 operates with an internal surface of the connector body 750 to stabilize the center conductor contact 780 and help retain substantially axial alignment of the center conductor contact 780 with respect to the connector 700. The first spacer 740 may be seated against an annular ridge 784 located on the center conductor contact 780. Seating the first spacer 740 against the annular ridge 784 may help retain the spacer 740 in a substantially fixed position along the axis of connector 700 so that the first spacer 740 does not axially slip or move due to interaction with the interface sleeve 760 when mating forces are applied. The first spacer 740 is located on a spacer portion 782 of the center conductor contact 780 and has a close tolerance fit therewith to help prevent wobbling and/or misalignment of the center conductor contact 780.

Figure 4:
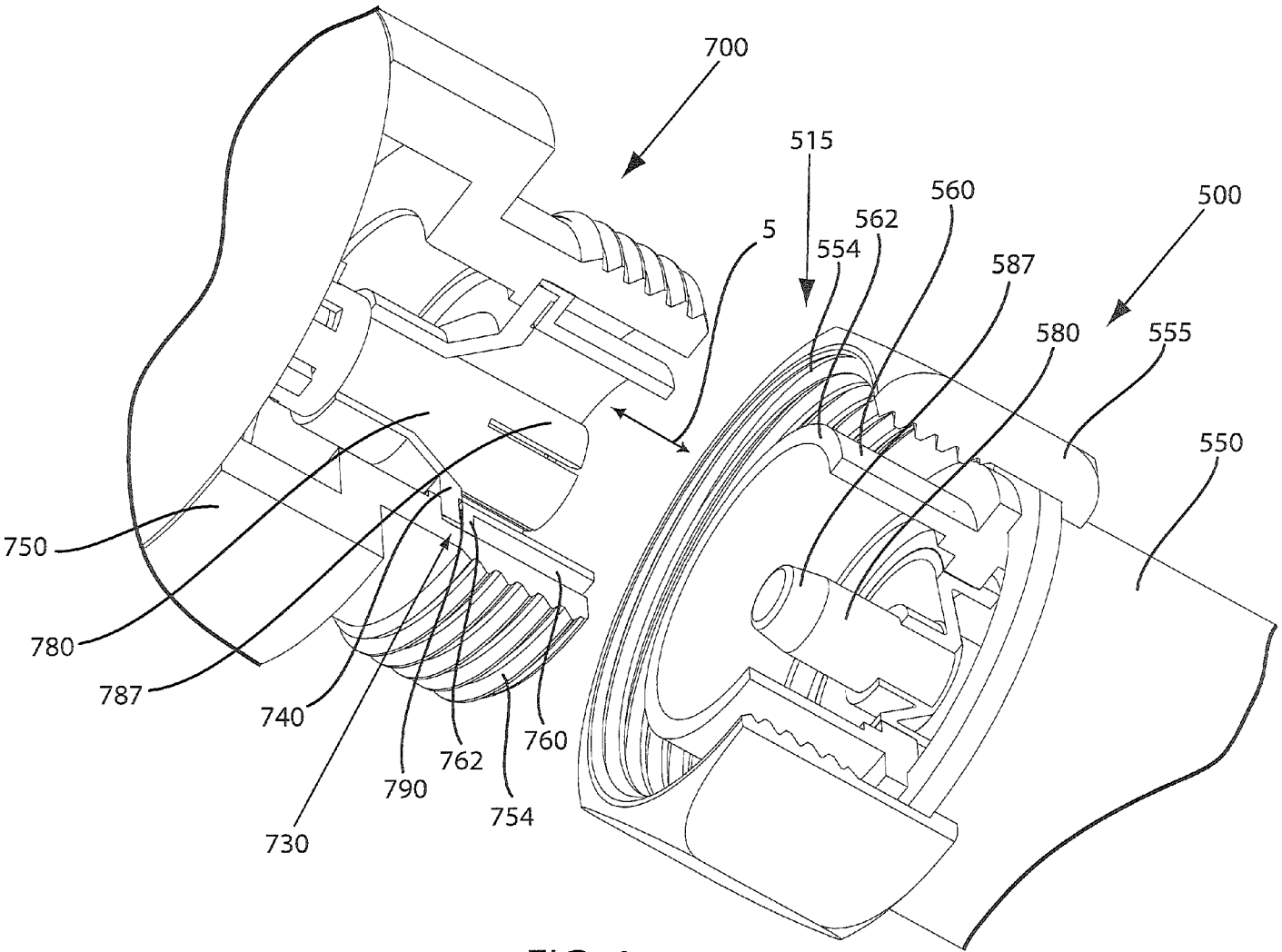
FIG. 4 depicts a cut-away perspective view of an embodiment of a mating force sensing coaxial cable connector just prior to mating with an embodiment of a male connector, in accordance with the present invention.
Figure 5:
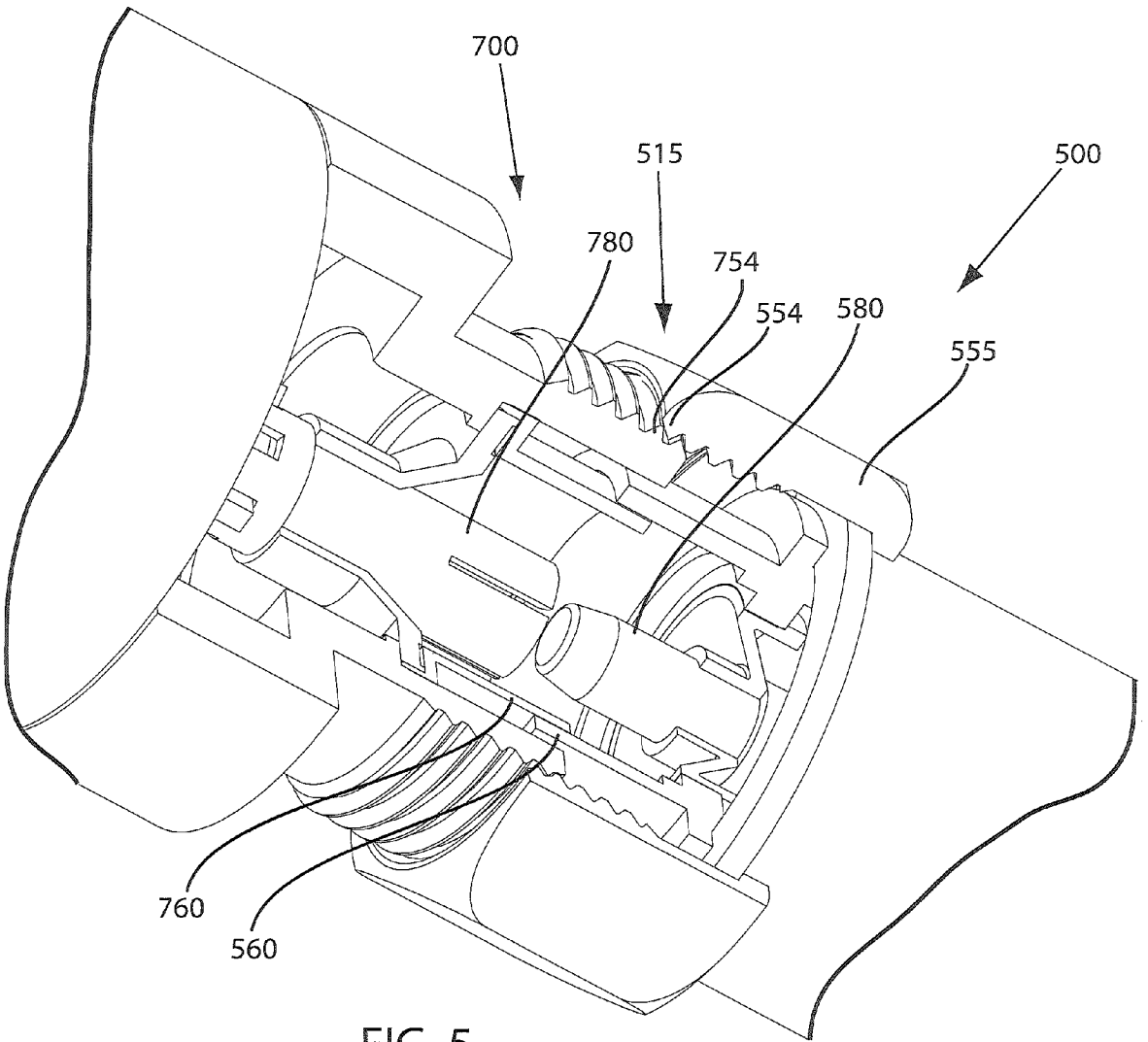
FIG. 5 depicts a cut-away perspective view of an embodiment of a mating force sensing coaxial cable connector during mating with an embodiment of a male connector, in accordance with the present invention.
Figure 6:
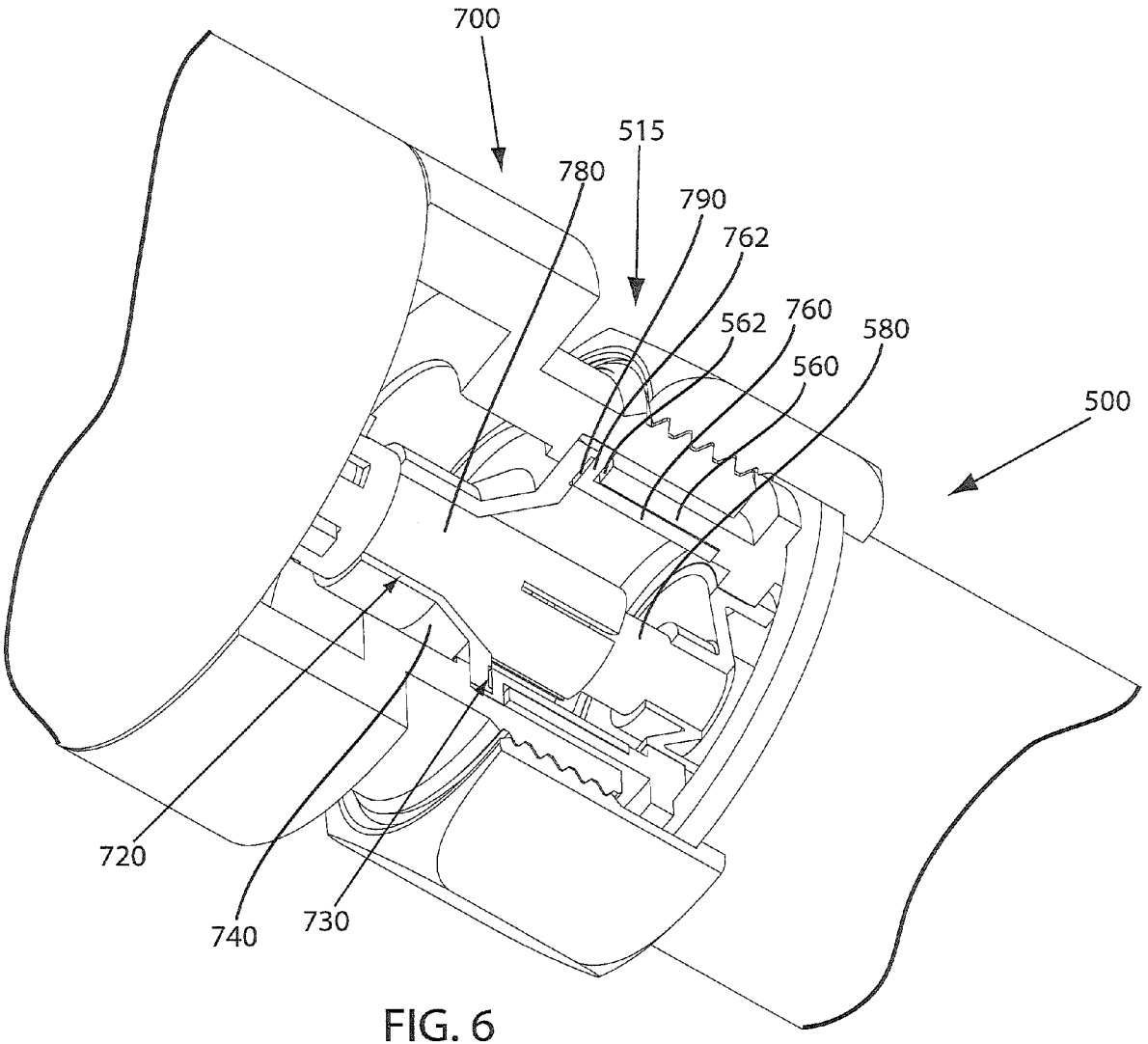
FIG. 6 depicts a cut-away perspective view of an embodiment of a mating force sensing coaxial cable connector mated with an embodiment of a male connector, in accordance with the present invention.

Mating of a connector 700 is described and shown with reference to FIGS. 4-6. A connector 700 can mate with RF ports of other components or coaxial cable communications devices, such as an RF port 515 of a male connector 500. The RF port 515 of the male connector 500 is brought into axial alignment with the mating force sensing connector 700. The two components are moved together or apart in a direction 5, as shown in FIG. 4. The male connector 500 may include a connector body 550 including an attached nut 555 having internal threads 554. The male connector 500 includes a conductive interface sleeve 560 having a leading edge 562. The interface sleeve 760 of the mating force sensing connector 700 may be dimensioned such that during mating the two interface sleeves 760 and 560 slidingly interact. The interface sleeve 760 may be designed to slidingly interact with the inner surface of the male connector 500 interface sleeve 560, as shown in FIG. 5. However, other embodiments of a connector 700 may include an interface sleeve 760 designed to slidingly interact with the outside surface of a connector component, such as interface sleeve 560. The sliding interaction of the interface sleeve 760 with the interface sleeve 560 may be snug, wherein the tolerance between the parts is close when the mating force sensing connector 700 is being mated to the male connector 500.

The female center conductor contact 780 of the force sensing connector 700 may include segmented portions 787. The segmented portions 787 may facilitate ease of insertion of a male center conductor contact 580 of the male connector 500. Additionally, the center conductor contact 580 of the male connector 500 may include a tapered surface 587 that further eases the insertion of the male center conductor contact 580 into the female center conductor contact 780. Those in the art should appreciate that a mating force sensing connector 700 may include a male center conductor contact 780 configured to mate with a female center conductor contact of another connector component.

FIG. 5 depicts an embodiment of a mating force sensing coaxial cable connector 700 during mating with an embodiment of an RF port 515 of a male connector 500. When the threaded nut 555 of the male connector 500 is initially threaded onto the threaded surface 754 of connector body 750, the interface sleeve 760 of the mating force sensing connector 700 may begin to slidingly advance against the inner surface of interface sleeve 560 of the male connector 500. The male center conductor contact 580 is axially aligned with the female center conductor contact 780 and readied for insertion therein.

When mated, the leading edge 562 of the interface sleeve 560 of the male connector 500 makes contact with the flexible member 762 of the interface sleeve 760 of the mating force sensing connector 700, as shown in FIG. 6. Contact between the leading edge 562 and the flexible member 762 facilitates transfer of force from the interface sleeve 560 to the interface sleeve 760. Mating force may be generated by the threading advancement of the nut 555 onto the threaded surface 754 of mating force sensing connector 700. However, mating force may be provided by other means, such as by a user gripping the connector body 550 of the male connector 500 and pushing it in a direction 5 (see FIG. 4) into mating condition with the force sensing connector 700. The force placed upon the flexible member 762 by the leading edge 562 may cause the flexible member 762 to bend.

Because the cavity or chamber 790 can be designed to have a known volume within a tight tolerance in an assembled mating force sensing connector 700, the sensing circuit 730 can be calibrated according to the known volume to sense corresponding changes in the volume. For example, if the male connector 500 is not threaded onto the mating force sensing connector 700 enough, then the leading edge 562 of the interface sleeve 560 does not place enough force against the flexible member 762 to bend the flexible member 762 sufficiently enough to create a change in the size of capacitive space 790 that corresponds to a sufficient and appropriate change in capacitance of the space 790. Hence, the sensing circuit 730, such as a capacitive circuit on the first spacer insulator component 740, will not sense a change in capacitance sufficient to produce a signal corresponding to a proper mating force attributable to a correct mated condition. Or, if the male connector 500 is threaded too far and too tightly onto the mating force sensing connector 700, then the leading edge 562 of the interface sleeve 560 will place too much force against the flexible member 762 and will bend the flexible member 762 more than is sufficient to create a change in the size of capacitive space 790 that corresponds to a sufficient and appropriate change in capacitance of the space 790. Hence, the sensing circuit 730, such as a capacitive circuit on the first spacer insulator component 740, will sense too great a change in capacitance and will produce a signal corresponding to an improper mating force attributable to a too tightly-fitted mated condition.

Proper mating force may be determined when the sensing circuit 730 signals a correct change in electrical capacitance relative to the size of capacitive space 790. The correct change in size may correspond to a range of volume or distance, which in turn may corresponds to a range of capacitance sensed by the sensing circuit 730. Hence, when the male connector 500 is advanced onto the mating force sensing connector 700 and the interface sleeve 560 exerts a force against the flexible member 762 of the interface sleeve 760, the force can be determined to be proper if it causes the flexible member to bend within a range that corresponds to the acceptable range of size change of capacitive space 790. The determination of the range acceptable capacitance change can be determined through testing and then associated with mating force conditions.

Once an appropriate capacitance range is determined, then calibration may be attributable to a multitude of mating force sensing connectors 700 having substantially the same configuration. The size and material make-up of the various components of the multiple connectors 700 can be substantially similar. For example, a multitude of mating force connectors 700 may be fabricated and assembled to have a regularly defined capacitive space 790 in immediate proximity with a bendable wall or boundary surface, such as flexible member 762, wherein the capacitive space 790 of each of the multiple connectors 700 is substantially the same size. Furthermore, the multiple connectors 700 may include a sensing circuit 730, such as a capacitive circuit, printed on a first spacer 740, the first spacer 740 being an insulator component. The sensing circuit 730 on each of the first spacers 740 of the multiple connectors 700 may be substantially similar in electrical layout and function. For instance, the sensing circuit 730 for each of the multiple connectors 700 may sense capacitance substantially similarly. Then, for each of the multitude of connectors 700, capacitance may predictably change relative to size changes of the capacitive space 790, attributable to bending of the flexible member 762 corresponding to predictable mating force. Hence, when capacitance falls within a particular range, as sensed by sensing circuit 730, then mating force can be determined to be proper for each of the multiple connectors 700 having substantially the same design, component make-up, and assembled configuration. Accordingly, each connector 700 of the multiple mating force connectors 700 having substantially the same design, component make-up, and assembled configuration does not need to be individually calibrated. Calibration can be done for an entire similar product line of connectors 700. Then periodic testing can assure that the calibration is still accurate for the line. Moreover, because the sensing circuit 730 is integrated into existing connector components, the mating force sensing connector 700 can be assembled in substantially the same way as typical connectors and requires very little, if any, mass assembly modifications.

Figure 7:
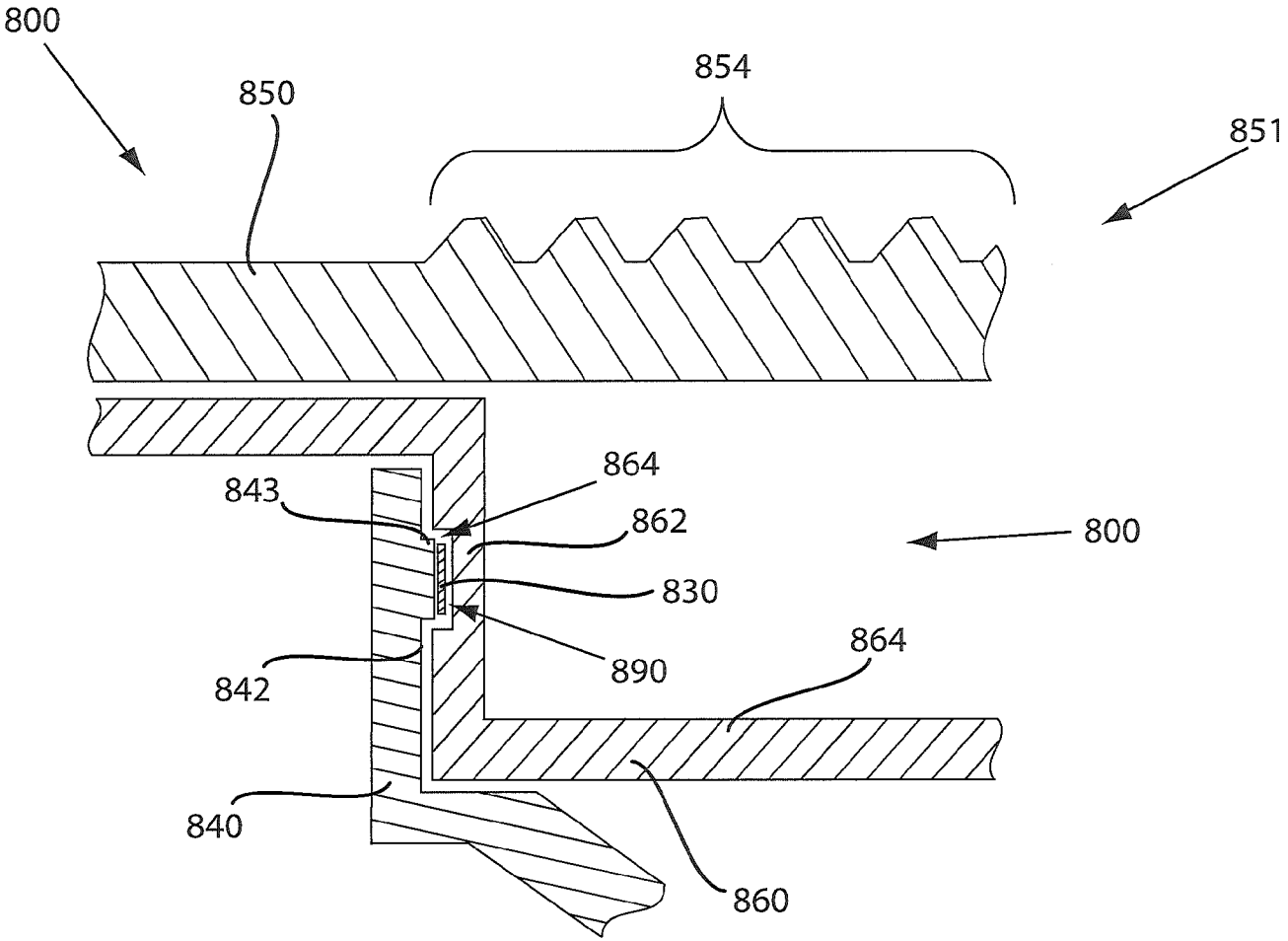
FIG. 7 depicts a partial cross-sectional view of a further embodiment of a coaxial cable connector with integrated force mating force sensing circuit, in accordance with the present invention.

With further reference to the drawings, FIG. 7 depicts a partial cross-sectional view of a further embodiment of a coaxial cable connector 800 with integrated force mating force sensing circuit 830. The mating force sensing circuit 830 may be a capacitive circuit positioned on a mount portion 843 of a first face 842 of an embodiment of a first spacing insulator 840. The capacitive circuit 830 may be printed on the mount portion 843. The mount portion 843 may protrude somewhat from the first face 842 of the first insulator 840 to help position the capacitive circuit 830 in immediate proximity with a first section bore 863 of a first section 862 of an interface member 860 to define a capacitive space 890 located between the face 842 and the insulator 840. The interface member 860 also includes a second section 864. The first section 862 of the interface member 860 may be flexible so that it can move between a first non-bent position and a second bent position upon the application of an axial force by a mating component 860 on the first section 862. When in a second bent position, the first section 862 of the interface member 860 may move closer to the first surface 842 of the spacing insulator 840 thereby decreasing the volume of the capacitive space 890 existent proximate the capacitive circuit 830 on the mount portion 843 immediately proximate the first section bore 863 of the first section 862. The capacitive circuit 830 can detect the decrease in size of the capacitive space 890 and correlate the change in size with mating force exerted on the interface member 860.

The connector 800 embodiment may include a connector body 850 having a threaded portion 854 located proximate a first end of the connector body 850. The first end 751 of the connector 800 may axially oppose a second end 852 of the connector 800 (not shown, but similar to second end 752 of connector 700 depicted in FIG. 1). In addition, the connector body 850 may include a first bore 856 extending axially from the first end 851. The first bore 856 may be large enough to accommodate the first spacing insulator 840 and the interface member 860 so that the connector body 850 may house the first insulator 840 and the interface member 860. Moreover, the first end 851, including the first bore 851, may be sized to mate with another coaxial cable component, such as male connector 500 depicted in FIGS. 4-6.

An embodiment of a method for detecting mating force of a mated coaxial cable connector 700, 800 is described with reference to FIGS. 1-7. One step of the mating force detecting method includes providing a coaxial cable connector, such as connector 700 or 800. The connector 700, 800 may include a sensing circuit 730, 830 positioned on a face 742, 842 of a spacer component 740, 840 located within a connector body 750, 850. In addition, the connector 700, 800 may include a capacitive space 790, 890 in immediate proximity with the sensing circuit 730, 830. Moreover, the connector 700, 800 may have an interface component 760, 860 having a flexible member 762, 862 forming at least one surface or boundary portion of the capacitive space 790, 890. The flexible member 762, 862 may be movable due to mating forces.

Another step of the coaxial cable connector mating force detection method includes mating the connector 700, 800 with a connecting device, such as the male connector 500, or any other structurally and functionally compatible coaxial cable communications component. Yet another mating force detection step includes bending the flexible member 762, 862 of the interface component 760, 860 due to contact with the connecting device, such as male connector 500, during mating, thereby reducing the size of the capacitive space 790, 890. Still further, the mating force detection methodology includes detecting mating force by sensing the reduction of capacitive space 790, 890 size by the sensing circuit 730, 830. The size change of the space 790, 890 may then be correlated with the mating force exerted on the interface member 760, 860.

The description of coaxial cable connectors 700, 800 capable of self-detecting mating connection force, has been, to this point only focused on structure pertaining to female coaxial cable connectors. The structure of female connectors makes it somewhat easier to fit deformable sensing elements into the overall connector 700, 800 designs. However, structural modifications may be made to male connector designs, such as the connector 500 shown in FIGS. 4-6, that render mating force self-detection capability.

Figure 8:
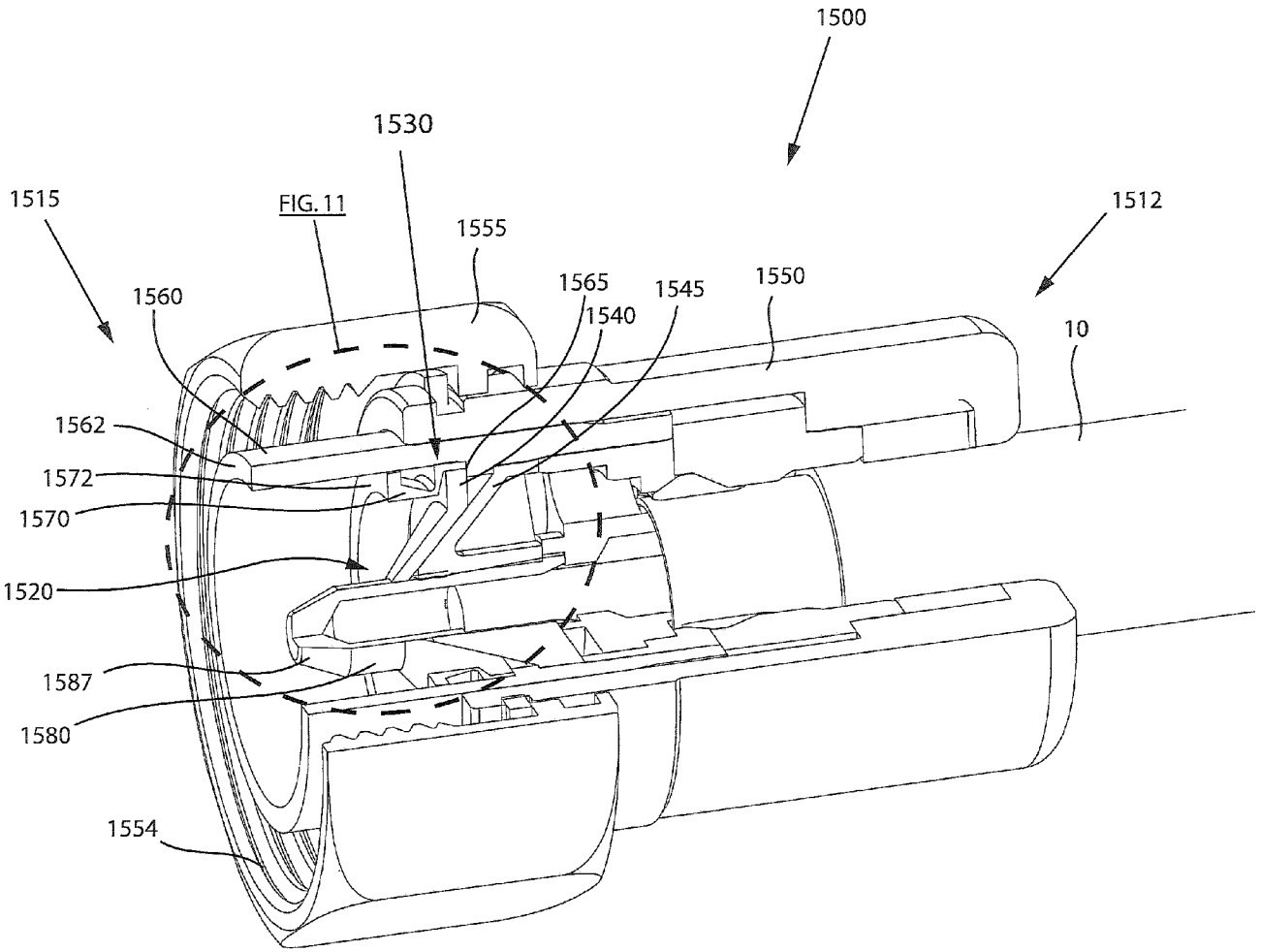
FIG. 8 depicts a cut-away perspective view of an embodiment of a male mating force sensing coaxial cable connector, in accordance with the present invention

With further reference to the drawings FIG. 8 depicts a male coaxial cable connector 1500 structured to self-detect mating force, when connected to a corresponding female connector, such as standard female connector, or a smart female connector such as connector 700 or connector 800 shown in FIGS. 1-8. Like the previously disclosed structures of the smart female connectors 700, 800, a male coaxial cable 1500 may include simple press-fit structures, which may be substituted for conventional male connector parts (like parts of the connector 500), thereby maintaining manufacturability within current methods and also thereby retaining a majority of common parts within the standard connector 1500 assembly.

Figure 9:
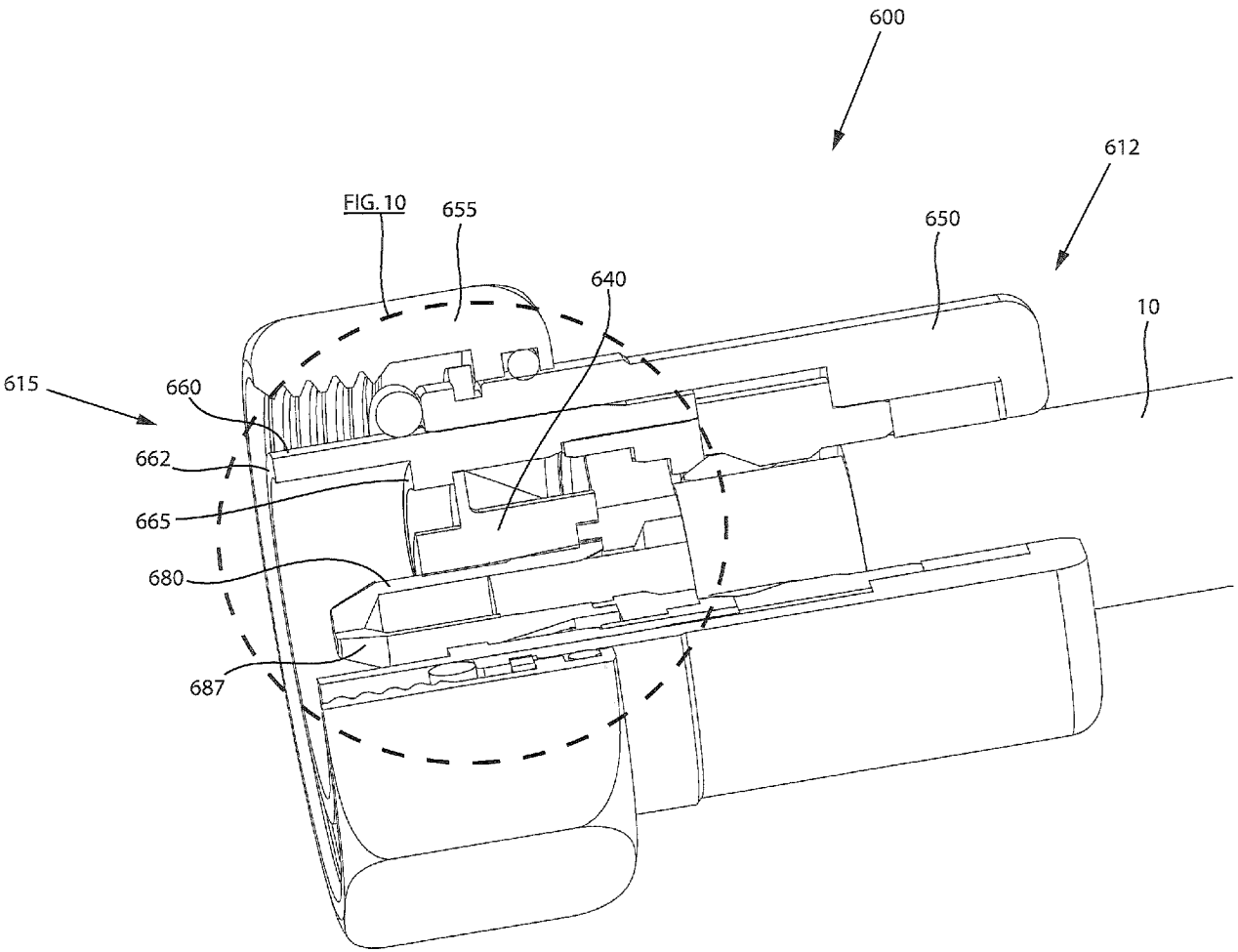
FIG. 9 (Prior Art)
FIG. 9 depicts a cut-away perspective view of a standard male coaxial cable connector
Figure 10:
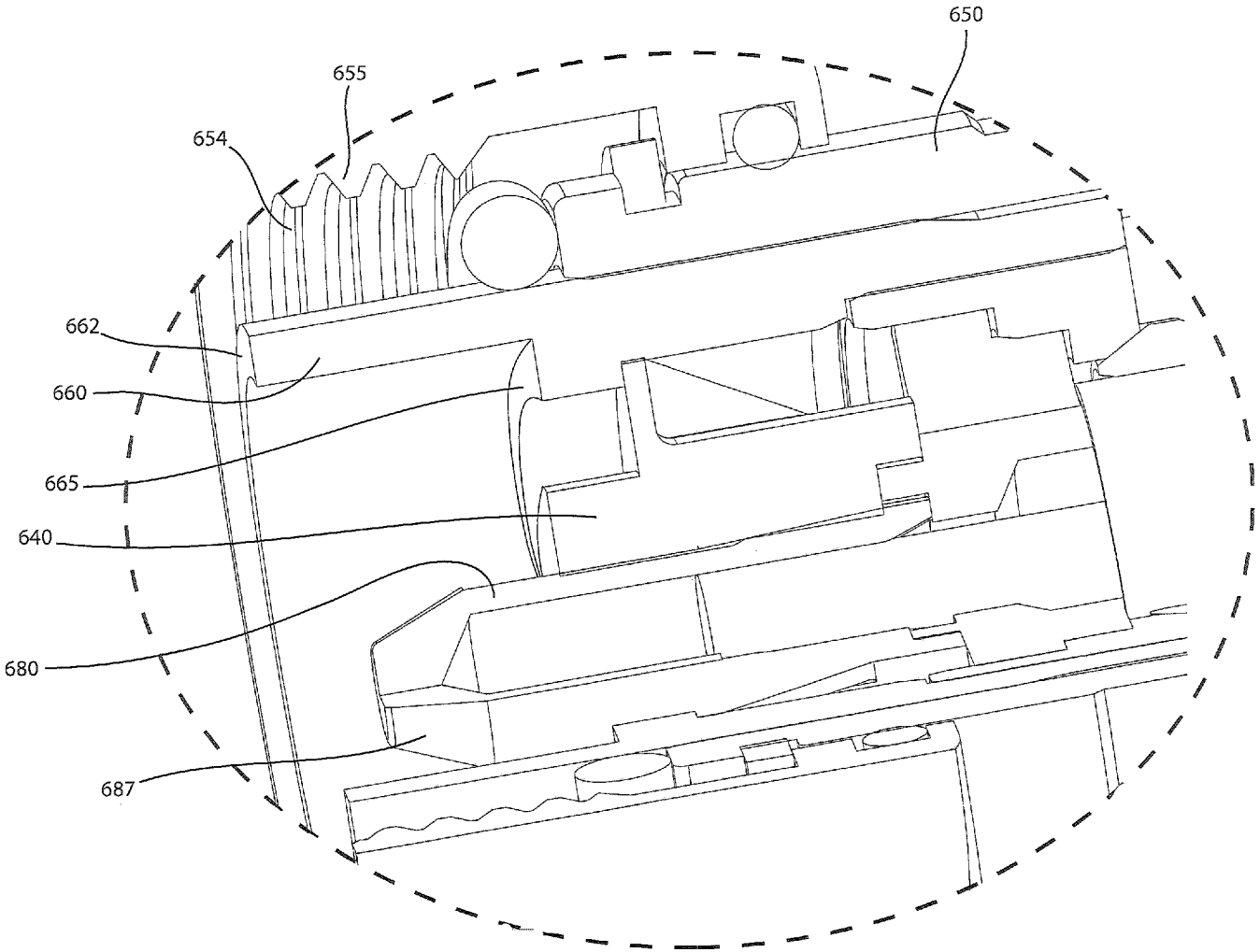
FIG. 10 (Prior Art)
FIG. 10 depicts a blown-up cut-away perspective view of the portion of the standard male coaxial cable identified and called out in FIG. 9.

To more clearly illustrate various types of connector structure that may be modified to provide a male connector 1500 with mating force self-detecting capability, FIGS. 9-10 are provided to show features of a standard male coaxial cable connector 600 having typical features. The standard male connector 600 may be structurally similar to the male coaxial cable connector 500 shown in FIGS. 4-6. The standard male connector 600 may include a connector body 650 configured to receive a coaxial cable 10 at a cable end 612 of the connector 600. A nut or other coupler 655 may be operably located proximate a port end 615 of the connector 600, the port end 615 being axially opposite the cable end 612. The coupler 655 may have internal threads 654 that facilitate rotatable connection with a complimentary feature of a female connector, such as connector 700.

A conductive interface sleeve 660, such as a conductive basket, or other conductive member structured and located to coaxially extend an RF barrier about a male center conductor 680 contact, so that the sleeve 660 may be electrically coupled to an outer coaxial conductor of the coaxial cable 10. The male center conductor contact 680 of the male connector 600 may include a tapered surface 687 that further eases the insertion of the male center conductor contact 680 into a female center conductor contact, such as contact 780 of female connector 700. The male center conductor contact 680 is electrically coupled to the center conductor of the coaxial cable 10.

The conductive interface sleeve 662 typically includes an inner ridge 665 or lip. The inner ridge 665 may serve to seat the leading edge of a corresponding interface sleeve, such as interface sleeve 760 of a female connector, such as connector 700, as shown generally in FIG. 6 with respect to similar male connector 500. The physical and electromagnetic interface between the conductive interface sleeve 662 of the male connector and the interface sleeve 760 of the female connector may help ground the coaxial cable connection and shield the respective center conductors from electromagnetic interference. The connector 600 may include an insulator 640 formed of a dielectric material, wherein the insulated 640 is housed within the connector body 650 and positioned to contact and axially align the male center conductor 680. The insulator 640 is positioned to rigidly suspend the inner conductor contact 680 within the outer conducting housing or connector body 650. The insulator 640 may be a spacer component positioned to help facilitate an operable communication connection of the connector 600. When the leading edge of the interface sleeve 762 is seated against the inner ridge 665 of the conductive interface sleeve 660 of male connector 600, the mated connection between the male connector 600 and the female connector 700 is generally close to complete. However, it is still possible for the connectors 600, 700 to be over-tightened or under-tightened. When over-tightened or under-tightened or in some other way not optimally tightened, the non-optimal mating conditions may render poor connection performance. Hence it is advantageous to detect mating force to determine whether a connector is optimally connected.

Figure 11:
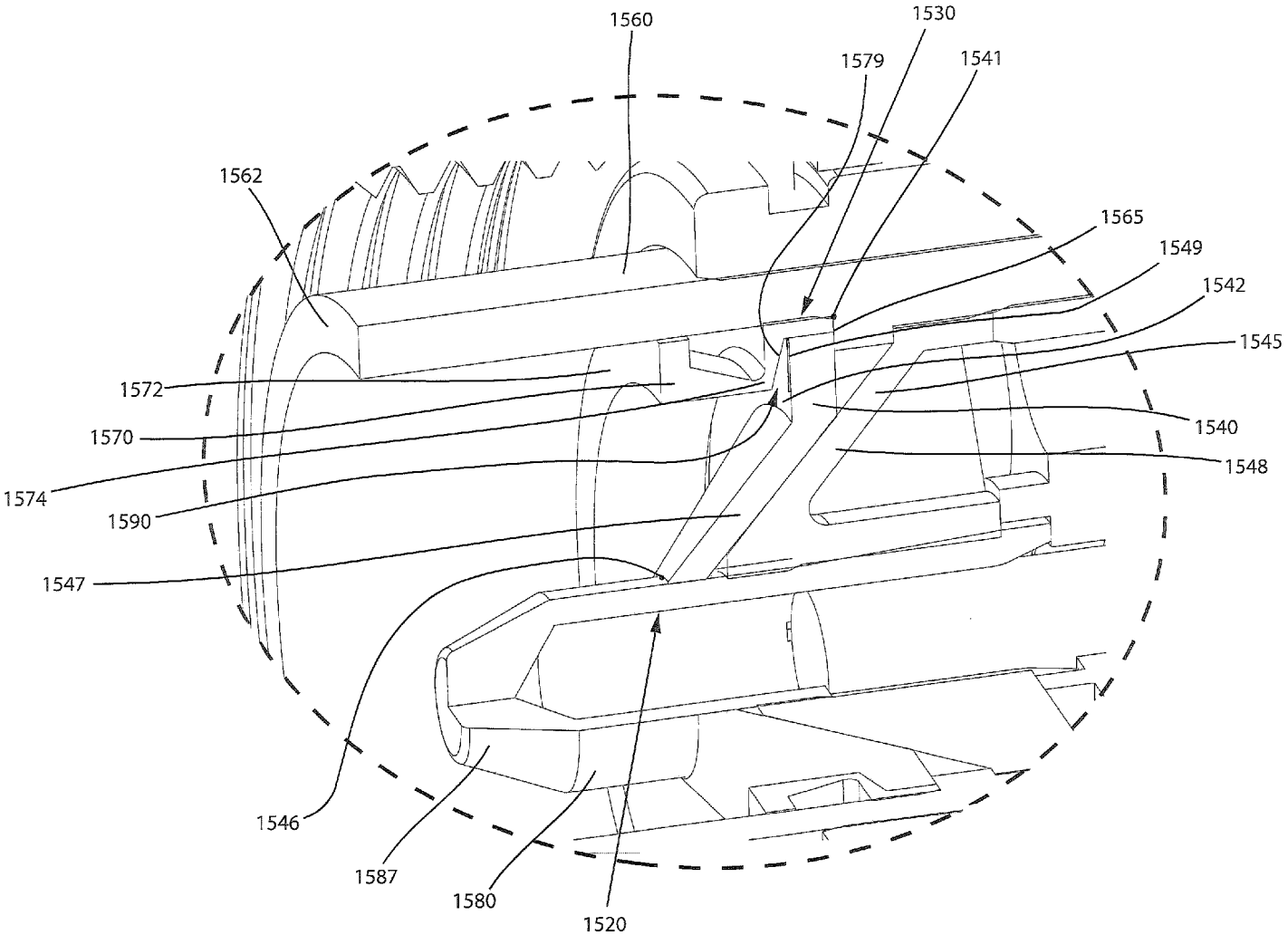
FIG. 11 depicts a blown up cut-away perspective view of the portion of the male coaxial cable connector identified and called out in FIG. 8, in accordance with the present invention.

Turning again to FIG. 8 and with additional reference to FIG. 11, a male coaxial cable connector 1500 includes structure facilitating capability to detect mating conditions. Like the standard male connectors 500, 600, a male coaxial cable connector 1500 includes a connector body 1550 having an internal passageway and being configured to receive a coaxial cable 10 at a cable end 1512 of the connector 1500. A nut or other coupler 1555 may be operably located proximate a port end 1515 of the connector 1500, the port end 1515 being axially opposite the cable end 1512. The coupler 1555 may have internal threads 1554 that facilitate rotatable connection with a complimentary feature of a female connector, such as connector 700. Moreover, like the typical male conductors 500, 600, a male coaxial cable conductor 1500 may include a male center conductor contact 1580. The male center conductor contact 1580 is electrically coupled to the center conductor of the coaxial cable 10. Furthermore, the male center conductor contact 1580 of the male connector 1500 may include a tapered surface 1587 that further eases the insertion of the male center conductor contact 1580 into a female center conductor contact, such as contact 780 of female connector 700.

Unlike a standard male connector, the male coaxial cable connector 1500 includes a flexible sleeve abutment member 1570 located within the connector 1500 so as to make contact and abut with an interface sleeve of a female port, such as sleeve 760 of connector 700 or sleeve 860 of connector 800. The flexible sleeve abutment member 1570 helps facilitate changes in the size of the capacitive space 1590 proximate the sensing circuit 1530. The flexible sleeve abutment member 1570 includes an abutment face 1572 and a compliant axially displaceable member 1574. The compliant axially displaceable member 1574 is structured to bend or otherwise flex under compression forces and allow for axial displacement of a cavity wall 1579 of the flexible sleeve abutment member 1570, when mating force is applied to the abutment face 1572 via contact with a tightening interface sleeve, such as sleeves 760, 860, of a female port, such as the first port ends 751, 851, of a female connector, such as connectors 700, 800. Located axially oppositely across a collapsible cavity 1590 from the cavity wall 1579 of the flexible sleeve abutment member 1570 is a sensor face 1542 of a sensor insulator 1540. A sensor 1530, such as a printed capacitive circuit, is located on the sensor face 1542 of the sensor insulator 1540. The sensor insulator 1540 is positioned to rigidly suspend the male center conductor contact 1580 in a coaxial location with respect to the outer conducting housing or connector body 1550.

The sensor insulator 1540 is disposed coaxially between and spans a radial distance between the male center conductor member 1580 and a conductive interface sleeve 1560. The conductive interface sleeve 1560 may be structured similar to the configuration of interface sleeves 560 and 660 of standard male conductors 500 and 600. The conductive interface sleeve 1560 coaxially surrounds at least a portion of the male center conductor contact 1580. However, the inner ridge 1565 of the conductive interface sleeve 1560 may be placed axially farther away from the first port end 1515 of the coaxial cable connector 1500 than are similar ridge features of standard connectors. This extra axial distance of the ridge 1565 away from the port end 1515 may operably accommodate the location of the flexible abutment member 1570. Additionally, the inclusion and provision of ridge 1565 can help secure the relative axial position of the flexible abutment member within the connector 1500. The flexible abutment member 1570 is seated against the inner ridge 1565 of the conductive interface sleeve 1560 when the connector is assembled. Hence, while portions of the connector 1500, such as the axial displacement member 1574, have some axially free movement with respect to other connector structure, the conjunctive operation and location of the inner ridge 1565 and the flexible abutment member 1570 work to prevent complete axial movement of the entire flexible abutment member 1570. In that sense, particular portions of the flexible abutment member 1570 can be permitted to move, while other portions remain stationary.

To help provide both axial and radial support, to various connector 1500 components, a second supportive insulator 1545 may be positioned to span between the conductive interface sleeve 1560 and the male center conductor member 1580. The shape of the supportive insulator 1545 may oppositely match the shape of the sensor insulator 1540. This match can be both axially and radially. For instance, both the sensor insulator 1540 and the second supportive insulator 1545 may have a diagonal span member, respectively 1547 and 1548. Hence the two insulators 1540 and 1545 can support and physically operate on each other in both axial directions and also radial directions. The second support insulator 1545 operates with the sensor insulator 1540 to further stabilize the sensor insulator.

When mated, the leading edge of the interface sleeve, such as sleeve 760 of the female connector 700 makes contact with the abutment face 1572 of the flexible abutment member 1570 of the male mating force sensing connector 1500. Contact between the sleeve 760 and the flexible abutment member 1570 facilitates transfer of force from the interface sleeve 760 during mating. Mating force may be generated by the threading advancement of the nut 1555 onto the threaded surface 754 of female connector 700. However, mating force may be provided by other means with regard to non-threaded structures, such as by a user gripping the connector body 1550 of the male connector 1500 and pushing it in a direction (similar to direction 5 shown in FIG. 4) into mating condition with the female connector 700. The force placed upon the flexible abutment member 1570 by the interface sleeve 760 may cause the flexible abutment member 1570 to bend, or otherwise be axially displaced.

Because the collapsible cavity 1590 can be designed to have a known dimension within a tight tolerance in an assembled male mating force sensing connector 1500, the sensing circuit 1530 can be calibrated according to the known dimension to sense corresponding changes in the capacitive space associated with the collapsible cavity 1590. For example, if the male connector 1500 is not threaded onto the female connector 700 enough, then the leading edge of the interface sleeve 760 does not place enough force against the flexible abutment member 1570 to bend the axially displaceable element 1574 sufficiently enough to create a change in the size of capacitive space 1590 that corresponds to a sufficient and appropriate change in capacitance of the space 1590. Hence, the sensing circuit 1530, such as a capacitive circuit 1549 printed on the sensor face 1572 of the sensor insulator component 1540, will not sense a change in capacitance sufficient to produce a signal corresponding to a proper mating force attributable to a correct mated condition. Or, if the male connector 1500 is threaded too far and too tightly onto the female connector 700, then the leading edge of the interface sleeve 760 will place too much force against the flexible abutment member 1570 and will bend the axially displaceable element 1574 more than is sufficient to create a change in the size of capacitive space 1590 that corresponds to a sufficient and appropriate change in capacitance of the space 1590. Hence, the sensing circuit 1530, such as a capacitive circuit 1549 on the sensor face 1572 of the sensor insulator component 1540, will sense too great a change in capacitance and will produce a signal corresponding to an improper mating force attributable to a too tightly-fitted mated condition. The cavity wall 1579 at least partially defines a capacitive space 1590 between the sensor face 1542 of the sensor insulator 1540 and the flexible abutment member 1570, wherein the cavity wall 1579 is movable upon the application of mating forces upon the flexible abutment member 1570.

Proper mating force may be determined when the sensing circuit 1530 signals a correct change in electrical capacitance relative to the size of capacitive space 1590. The correct change in size may correspond to a range of volume or distance, which in turn may corresponds to a range of capacitance sensed by the sensing circuit 1530. Hence, when the male connector 1500 is advanced onto a female connector 700 and the interface sleeve 760 exerts a force against the abutment face 1572 of the flexible abutment member 1570, the force can be determined to be proper if it causes the axially displaceable element 1574 of the flexible abutment member 1570 to bend within a range that corresponds to the acceptable range of size change of capacitive space 1590. The determination of the range acceptable capacitance change can be determined through testing and then associated with mating force conditions. In this sense, connectors 1500 may be calibrated for optimal performance.

Once an appropriate capacitance range is determined, then calibration may be made attributable to a multitude of similar male mating force sensing connectors 1500 having substantially the same configuration. The size and material make-up of the various components of the multiple male connectors 1500 can be substantially similar. For example, a multitude of male mating force connectors 1500 may be fabricated and assembled to have a regularly defined capacitive space 1590 in immediate proximity with a movable body or boundary surface, such as cavity wall 1579 of flexible abutment member 1570, wherein the capacitive space 1590 of each of the multiple connectors 1500 is substantially the same size. Furthermore, the multiple connectors 1500 may each include a sensing circuit 730, such as a capacitive circuit, printed on a sensor face 1542 of a sensor insulator 1540. The sensing circuit 1530 on each of the sensing insulators of the multiple connectors 1500 may be substantially similar in electrical layout and function. For instance, the sensing circuit 1530 for each of the multiple connectors 1500 may sense capacitance substantially similarly. Then, for each of the multitude of connectors 1500, capacitance may predictably change relative to size changes of the capacitive space 1590, attributable to bending of the axially displaceable element 1572 of the flexible abutment member 1570 corresponding to predictable mating force. Hence, when capacitance falls within a particular range, as sensed by sensing circuit 1530, then mating force can be determined to be proper for each of the multiple male connectors 1500 having substantially the same design, component make-up, and assembled configuration. Accordingly, each connector 1500 of the multiple mating force connectors 1500 having substantially the same design, component make-up, and assembled configuration does not need to be individually calibrated. Calibration can be done for an entire similar product line of male coaxial cable connectors 1500. Then periodic testing can assure that the calibration is still accurate for the line. Moreover, because the sensing circuit 1530 is integrated into existing connector components, the male mating force sensing connector 1500 can be assembled in a manner similar to typical coaxial cable connectors.

The sensor insulator 1540 may include a sensor face 1542 on which a sensing circuit 1530 may be positioned. The face 1542 may be the top edge of an annular ring-like base flange protruding from the cone-like sensor insulator 1540 and the sensing circuit 1530 may be printed onto the face 1542. For example, a capacitive circuit 1549 may be printed on the face 1542 of the sensor insulator 1540, wherein the capacitive circuit 1549 is a sensing circuit 1530. Printing the sensing circuit 1530 onto a sensor face 1542 of the sensor insulator 1540 affords efficient connector 1500 fabrication because the sensing circuit 1530 can be provided on components, such as spacer insulators typically existent in cable connectors. Moreover, assembly of the connector 1500 is made efficient because the various connector components, such as the sensor insulator 1540, male center conductor 1580, interface sleeve 1560, connector body 1550 and second supportive insulator 1545, are assembled in a manner consistent with typical connector assembly. Printing a sensing circuit 1530 on a typical component can also be more efficient than other means because assembly of small non-printed electronic sensors to the interior surfaces of typical male coaxial cable connector housings, possibly wiring those sensors to a circuit board within the housing and calibrating the sensors along with any mechanical elements, can be difficult and costly steps. A printed sensing circuit 1530 integrated on a typical connector 1500 assembly component reduces assembly complexity and cost. Accordingly, it may be desirable to "print" sensing circuits 1530 and other associated circuitry in an integrated fashion directly onto structures, such as the sensor face 1542 of the sensor insulator 1540 or other structures already present in a typical connector 1500. Furthermore, printing the sensing circuits 1530 onto connector 1500 components allows for mass fabrication, such as batch processing of the sensor insulators 1540 to include components having sensing circuits 1530 printed thereon. Printing the sensing circuit 1530 may involve providing conductive pathways, or traces, etched from copper sheets or other conductive materials, laminated or otherwise positioned onto a non-conductive substrate, such as the sensor insulator component 1540.

When the connector 1500 is assembled, the movable cavity wall 1579 is in immediate proximity with the capacitive space 1590; the capacitive space 1590 residing between the movable cavity wall and the printed capacitive circuit 1549 located on the sensor face 1542 of the sensor insulator 1540. Movements of the flexible abutment member 1570 cause the cavity wall 1579 to move resulting in changes in the size associated with the capacitive space 1590. The cavity wall 1579 of the flexible abutment member 1570 may be configured to undergo elastic deformation as a result of mating forces. The capacitive space 1590 size may therefore be dynamic. Changes in the size of the capacitive space 1590 may produce changes in the capacitance of the printed sensing circuit 1530 and are therefore ascertainable as a physical parameter status. The sensor face 1542 of the insulator 1540 may be or include a fixed electrode, such as a fixed plate, and the cavity wall 1579 of the flexible abutment member 1570 may be or include a movable electrode. The distance between the electrodes, or the size of the capacitive space between the electrodes, may vary inversely with the applied torque. The closer capacitive wall 1579 gets to the capacitive circuit 1549 on the sensor face 1542 of the sensor insulator 1540, the larger the effective capacitance becomes. The sensing circuit 1530 translates the changes in capacitance to connector tightness and determines if the connector 1500 is too loose. The capacitive space 1590 may be a resonant chamber or capacitive cavity. The dimensional space of the capacitive space 1590 can be manufactured to tight tolerances. For example, the flexible abutment member 1570 and/or the sensor insulator 1540 may be injection molded to form conjunctive shapes corresponding to an open annular collapsible diaphragm capacitor responsive to resonant variation due to changes in the size of cavity 1590. The capacitive space 1590 may be filled with air, wherein the air may function as a dielectric. However, the capacitive space 1590 may be completely or partially filled with some other material such as dielectric grease. Because the male connector 1500 assembly creates a sandwich of parts, the capacitive space or resonant cavity 1590 and sensing circuit 1530 need not be adjusted or calibrated individually for each connector assembly, making assembly of the male connector 1500 no different from a similar common male coaxial cable connector that has no sensing circuit 1530 built in.

Power for the sensing circuit 1530 of a male coaxial cable connector 1500 may be provided through electrical contact with the male center conductor 1580. For instance, traces may be printed on the sensor insulator 1540 and positioned so that the traces make electrical contact with the male center conductor contact 1580 at a location 1546. Contact with the center conduct contact 1580 at location 1546 facilitates the ability for the sensing circuit 1530 to draw power from the cable signal(s) passing through the male center conductor contact 1580. Traces may also be formed and positioned so as to make contact with grounding components. For example, a ground path may extend through a location 1541 between the sensor insulator 1540 and/or the flexible abutment member 1570 and the interface sleeve 1560.

The sensing circuit 1530 can communicate sensed mating forces. The sensing circuit 1530, such as a capacitive circuit, may be in electrical communication with an output component such as traces physically and electrically connected to the male center conductor contact 1580. For example, sensed conditions due to mating forces, such as changes in capacitance of the cavity or chamber 1590, may be passed as an output signal from the sensing circuit 1530 of the sensor insulator 1540 through an output component 1520, such as traces, electrically linked to the male center conductor contact 780. The outputted signal(s) can then travel along the cable line corresponding to the cable connection applicable to the male coaxial cable connector 1500. Hence, the signal(s) from the sensing circuit 1530 may be accessed at a point along the cable line. For example, the signals may be routed to a display system enabling a technician to visual observe operable performance characteristics of the connector 1500. In addition, traces or conductive elements of an output component 1520 in communication with a sensing circuit 1530 may be in electrical contact with output leads available to facilitate connection of the male coaxial cable connector 1500 with electronic circuitry that can manipulate the sensing circuit 1530 operation. For instance, sensed data pertaining to performance characteristics of the connector 1500 may be reported to external devices which may further analyze the data. Moreover, sensed conditions may be outputted in the form of alarms signifying the need to further observe the connector 1500.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A male coaxial cable connector for connecting a coaxial cable to a female mating component, the female mating component having a conductive interface sleeve, the male coaxial cable connector comprising:

a connector body, configured to receive a coaxial cable;

a male center conductor contact, electrically coupled to the coaxial cable;

a conductive interface sleeve, coaxially surrounding at least a portion of the male center conductor contact;

a sensor insulator, spanning a radial distance between the conductive interface sleeve and the male center conductor contact;

a capacitive circuit positioned on a sensor face of the sensor insulator; and, a flexible abutment member positionable proximate the conductive interface sleeve, the flexible abutment member having a cavity wall, wherein the cavity wall at least partially defines a capacitive space between the sensor face of the sensor insulator and the flexible abutment member, wherein the cavity wall is movable upon the application of mating forces upon the flexible abutment member.

2. The connector of claim 1, wherein the flexible abutment member further comprises an axially displaceable element to bend or otherwise flex under compression forces and allow for axial displacement of the cavity wall of the flexible sleeve abutment member.

3. The connector of claim 1, wherein the sensor insulator is positioned to contact and axially align the center conductor within the connector body.

4. The connector of claim 1 further comprising a second supportive insulator located to operate with the sensor insulator to further stabilize the sensor insulator.

5. The connector of claim 1, wherein a port end of the connector body includes a threaded nut rotatably operable to connect with a corresponding threaded portion of a female structure.

6. The connector of claim 1, wherein the sensor insulator includes traces positioned at a location to make electrical contact with the male center conductor contact when the connector is assembled.

7. The connector of claim 1, wherein the sensor insulator includes traces positioned at a location to ground the capacitive circuit when the connector is assembled.

8. The connector of claim 1, wherein the flexible abutment member is seated against an inner ridge of the conductive interface sleeve when the connector is assembled.

9. A male coaxial cable connector comprising:

a male center conductor;

a capacitive circuit positioned on a sensor face of a sensor insulator, the sensor insulator positioned within the connector to rigidly suspend the male center conductor contact in a coaxial location with respect to an outer connector body;

a flexible abutment member located between the conductive interface sleeve and the male center conductor contact, the flexible abutment member having a cavity wall, the cavity wall located proximate the sensor face of the sensor insulator, the cavity wall of the flexible abutment member being movable due to mating forces when the connector is connected to a mating component; and a capacitive cavity located between the sensor face of the sensor insulator and the cavity wall of the flexible abutment member; wherein the cavity wall of the flexible abutment member forms at least one boundary surface of the capacitive cavity, and the sensor face of the sensor insulator forms at least another boundary surface of the capacitive space.

10. The connector of claim 9, wherein the sensor insulator includes traces positioned at a location to ground the capacitive circuit when the connector is assembled.

11. The connector of claim 9 further comprising a second supportive insulator to operate with the sensor insulator to further stabilize the sensor insulator.

12. The connector of claim 9, wherein the sensor insulator includes traces positioned at a location to make electrical contact with the male center conductor contact when the connector is assembled.

13. The connector of claim 11, wherein the sensor insulator and the flexible abutment member are both seated against an inner ridge of a conductive interface sleeve when the connector is assembled.

14. A mating force sensing male coaxial cable connector comprising:

a sensing circuit printed on the face of a sensor insulator positioned to rigidly suspend a male center conductor contact within an outer conducting sleeve, the sensing circuit located between an inner radial surface of a conductive interface sleeve and an outer radial surface of a male center conductor of the mating force sensing male coaxial cable connector; and a capacitive space in proximity with the sensing circuit, said capacitive space having at least one defining wall configured to undergo elastic deformation as a result of mating forces.

15. The connector of claim 14, wherein the sensing circuit is a capacitive circuit.

16. The connector of claim 14 further comprising a flexible abutment member to help facilitate changes in the size of the capacitive space proximate the sensing circuit.

17. The connector of claim 16, wherein the wall of the cavity is a resilient portion of the flexible abutment member.

18. The connector of claim 14, wherein the sensor insulator includes traces positioned at a location to make electrical contact with the male center conductor contact and traces positioned at a location to ground the sensing circuit when the connector is assembled.

19. The connector of claim 14 further comprising second supportive insulator located to operate with the sensor insulator to retain substantially coaxial alignment of the male center conductor contact with respect to the outer conducting sleeve when the connector is assembled.

20. A male coaxial cable connector comprising:

a connector body;

an sensor insulator and a flexible abutment member at least partially housed by the connector body, the flexible abutment member positionable proximate a conductive interface sleeve of the male coaxial cable connector;

a capacitive space formed between the sensor insulator and the flexible abutment member; and means for sensing proper mating by determining a change in size of the capacitive space due to mating forces.

21. The connector of claim 20 further comprising a male center conductor contact to facilitate operable communication with a female mating component.

22. A method for detecting mating force of a mated male coaxial cable connector, said method comprising:

providing a male coaxial cable connector including:

a sensing circuit positioned on a face of a spacer component located within a connector body;

a capacitive space in immediate proximity with the sensing circuit; and a flexible abutment member positionable proximate a conductive interface sleeve, the flexible abutment member having a portion thereof forming at least one boundary surface of the capacitive space, said portion of the flexible abutment member being movable due to mating forces;

mating the male connector with a connecting female device;

bending the axially displaceable element of the flexible abutment member to move the boundary surface portion thereof due to contact with the connecting female device during mating, thereby reducing the size of capacitive space; and detecting mating force by sensing the reduction of size of the capacitive space by the sensing circuit.

23. The method of claim 22 further comprising powering the sensing circuit.

24. The method of claim 22 further comprising grounding the sensing circuit.

25. The method of claim 22 further comprising calibrating the sensing circuit.

* * * * *